US005492227A

United States Patent [19]

Millette et al.

[11] Patent Number: 5,492,227

[45] Date of Patent: Feb. 20, 1996

[54] SEGREGATION AND STORAGE APPARATUS FOR RECYCLABLES

[76] Inventors: Robert T. Millette; JoAnne F. Millette, both of 440 Concord Stage Rd., Weare, N.H. 03281

[21] Appl. No.: 267,351

[22] Filed: Jun. 29, 1994

[51] Int. Cl.[6] ..... B07C 7/04

[52] U.S. Cl. ..... 209/703; 209/930

[58] Field of Search ..... 209/703, 702, 209/930; 193/33, 14, 2 R, 2 D; 232/43.2, 43.4, 44

[56] References Cited

U.S. PATENT DOCUMENTS

| | | | |
|---|---|---|---|
| 1,935,130 | 11/1933 | Schauman | 232/43.4 X |
| 2,579,379 | 12/1951 | Fritsche | 232/43.4 X |
| 3,204,740 | 9/1965 | Legault | 232/44 X |
| 3,279,685 | 10/1966 | Price | 232/43.2 |
| 4,373,435 | 2/1983 | Grevich | 209/930 X |
| 4,660,758 | 4/1987 | Tavel et al. | 232/43.2 |
| 5,014,858 | 5/1991 | Armstrong | 209/641 |
| 5,083,704 | 1/1992 | Rounthwaite | 209/702 X |
| 5,221,010 | 6/1993 | Bianco | 209/703 X |
| 5,257,577 | 11/1993 | Clark | 209/930 X |
| 5,271,507 | 12/1993 | Evans, Jr. | 209/930 X |
| 5,280,688 | 1/1994 | Zoccoli | 209/702 X |
| 5,366,097 | 11/1994 | Hazelwood | 209/930 X |

*Primary Examiner*—David H. Bollinger
*Attorney, Agent, or Firm*—Michael I. Kroll

[57] ABSTRACT

An apparatus that allows the segregation of separated recyclable materials outdoors includes a wall unit mounted in an existing exterior wall of a domicile and between the existing studs therein. On the inner portion of the wall unit is a hinged, insulated cover and on the outer portion is a plurality of conduits extending outwardly and downwardly from the exterior wall of the home to allow for depositing of recyclable materials in appropriate bins or containers placed below.

1 Claim, 2 Drawing Sheets

SEGREGATION AND STORAGE APPARATUS FOR RECYCLABLES

BACKGROUND OF THE INVENTION

REFERENCE TO RELATED PUBLICATIONS

This invention was registered in the United States Patent and Trademark Office under the Document Disclosure Program. The date received was May 10, 1993 and the registration number is 330,143.

1. Field of the Invention

The present invention relates to a segregation and storage apparatus for recyclable materials. More specifically, it relates to an apparatus that consists of a wall unit mounted between the studs of an existing wall. The side of the wall unit that faces the inner portion of the home has a vertically swinging, hinged cover that fits snugly thereover and is insulated to prevent any heat transfer between the home and the outer air. Extending from the other side of the wall unit are a plurality of pipes or chutes that extend outwardly and downwardly to corresponding separate storage containers.

The unique drain plug of the instant invention could be applied in many other fields where it is desired to provide remote separate storage of individual articles. The artisan could see many other applications as, for example, a production facility where different parts are chuted to different storage locations. Thus it can be seen that the potential fields of use for this invention are myriad and the particular preferred embodiment described herein is in no way meant to limit the use of the invention to the particular field chosen for exposition of the details of the invention.

A comprehensive listing of all the possible fields to which this invention may be applied is limited only by the imagination and is therefore not provided herein. Some of the more obvious applications are mentioned herein in the interest of providing a full and complete disclosure of the unique properties of this previously unknown general purpose article of manufacture. It is to be understood from the outset that the scope of this invention is not limited to these fields or to the specific examples of potential uses presented hereinafter.

2. Description of the Prior Art

As the problem of shrinking areas available for the placement of landfills is faced by municipality after municipality across the country, these communities are forced to implement recycling programs to relieve the strain on the available fill area. Materials that have exceptionally long biodegradation times, or materials that do not biodegrade at all, are singled out for these efforts. Aluminum, glass, and certain polymers are in this class of materials. Another advantage of this recycling effort is that these materials can be reprocessed to manufacture more of the same, with a concurrent saving in energy, money, and resources. Most of the municipalities implementing these programs require the householder to separate the various materials into segregated containers. A problem encountered by many people is the storage of the bins or containers during the time between use and pickup, which in many cases is on a weekly basis. The bins take up space, usually in the kitchen or storage room, which discourages conscientious collection when space is at a premium. In homes with a large number of occupants, this drawback is exacerbated. The present invention seeks to ameliorate this problem by providing an apparatus that extends from the indoors to the outdoors, with a wall unit placed between the existing wall studs, having an insulated hinged cover on the inner wall and a plurality of separate pipes or chutes extending outwardly and downwardly from the outer wall. A number of U.S. Patents were uncovered during a search that relate to recycling, and they are hereinafter discussed:

U.S. Pat. No. 4,373,435, issued to John J. Grevich on Feb. 15, 1983, discloses a crusher and separator for cans and bottles wherein the objects are crushed and then, through gravity and a magnetic belt, are separated into the appropriate containers. Unlike the present invention, this separator is clearly designed to be used at the recycling center or site, and makes no use of an existing wall to transport and then store the recyclable material outdoors.

The next patent of interest is U.S. Pat. No. 4,660,758, issued on Apr. 28, 1987, to Goldie K. Tavel et al. In this there is disclosed a waste separator-receptacle wherein a plurality of pivoting doors are adapted to receive various recyclable materials. Disposed within the enclosure is included a means to dispense a fluid, preferably a germicide, deodorizer, or the like. Unlike the present invention, there is no teaching of segregating the recyclable materials outdoors, nor is any communication means between an inner and outer wall of a domicile disclosed.

In U.S. Pat. No. 5,014,858 issued on May 14, 1991, to Ernest T. Armstrong there is disclosed a refuse separator. This is a lid, having a chute therein, for a trash receptacle that is designed such that cans or bottles, attaining a higher velocity when traversing the chute, are deposited in one portion of the receptacle, while other refuse having a higher friction coefficient or less weight will be deposited in another. This, as in the other patents discussed above, has no teaching directed to a wall unit mounted to allow recyclables to be segregated outside of the domicile.

Lastly, in U.S. Pat. No. 5,221,010 issued on Jun. 22, 1993, to James S. Bianco, there is disclosed an apparatus for segregating bottles, cans, and the like. This device has a plurality of conduits extending from an upper, kitchen area to a lower, storage area having the bins contained therein. There is no teaching of the mounted wall unit envisioned by the present invention for communicating with the outside of the domicile, thus allowing the segregation of the recyclable materials outdoors.

None of the above inventions and patents, taken either singly or in combination, is seen to describe the instant invention as claimed.

SUMMARY OF THE INVENTION

The present invention is an apparatus that allows the segregation of separated recyclable materials outdoors. The device consists of a wall unit mounted in an existing wall and between the existing studs therein. On the inner portion of the wall unit is a hinged, insulated cover and on the outer portion is a plurality of conduits extending outwardly and downwardly from the exterior wall of the home to allow for depositing of recyclable materials in appropriate bins or containers placed below.

Accordingly, it is a principle object of the invention to provide an apparatus for the segregation and storage of recyclable materials wherein the material to be stored can be held in an outdoor location to free floor space within the domicile.

It is another object of the invention to provide an apparatus for the segregation and storage of recyclable materials wherein a wall mounted unit is placed within the wall, to provide access to the conduits or piping attached thereto, that extend downwardly and outwardly from the exterior of the wall.

It is a further object of the invention to provide an apparatus for the segregation and storage of recyclable materials wherein the wall mounted unit has attached thereto, on the inwardly disposed portion, an insulated hinged cover means to prevent heating or cooling from escaping from the interior of the home.

Still another object of the invention is to provide an apparatus for the segregation and storage of recyclable materials wherein the conduits or piping extending from the wall mounted unit are terminated a sufficient distance above the tops of the bins or containers that the bins can be easily removed for curbside pickup or transportation to a recycling center when full.

It is a major goal of the invention to provide improved elements and arrangements thereof in an apparatus for the purposes described which is inexpensive, dependable and fully effective in accomplishing its intended purposes.

The present invention meets or exceeds all the above objects and goals. Upon further study of the specification and appended claims, further objects and advantages of this invention will become apparent to those skilled in the art.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENT

Figure 1:
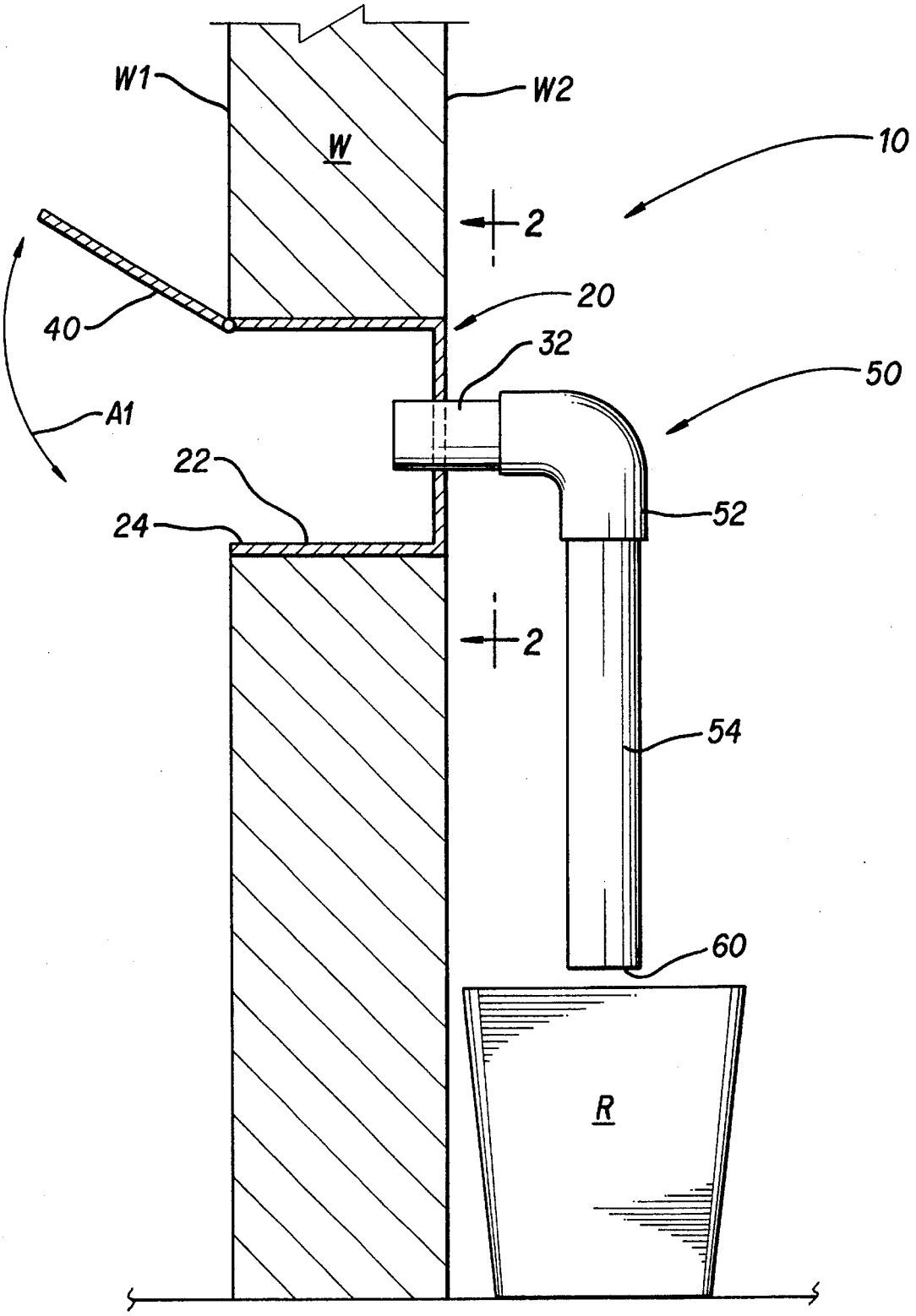
FIG. 1 is a cross sectional view of the wall of a domicile, showing the wall mounted unit therein, the insulated hinged cover, and one of the pipe conduits extending outdoors.

The present invention is indicated in FIG. 1 as 10. The apparatus 10 can be understood as being comprised primarily of two components: the wall mounted unit portion 20 and the conduit means portions 50. It should be understood, that in the embodiment discussed herein, that the conduits 50 are all identically constructed, and that in discussing the specific details of one, we will, in essence, be discussing them all.

Figure 2:
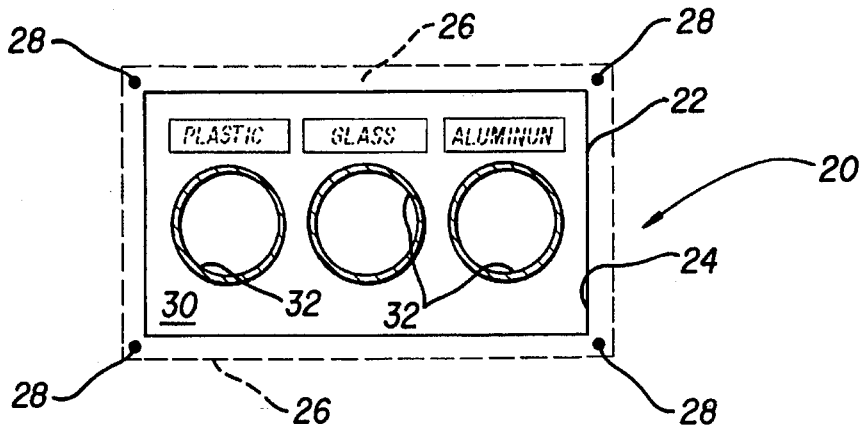
FIG. 2 is a front view into the wall mounted unit showing the three conduit mouths, with corresponding indicia to indicate the type of recyclable material to be deposited in each.
Figure 3:
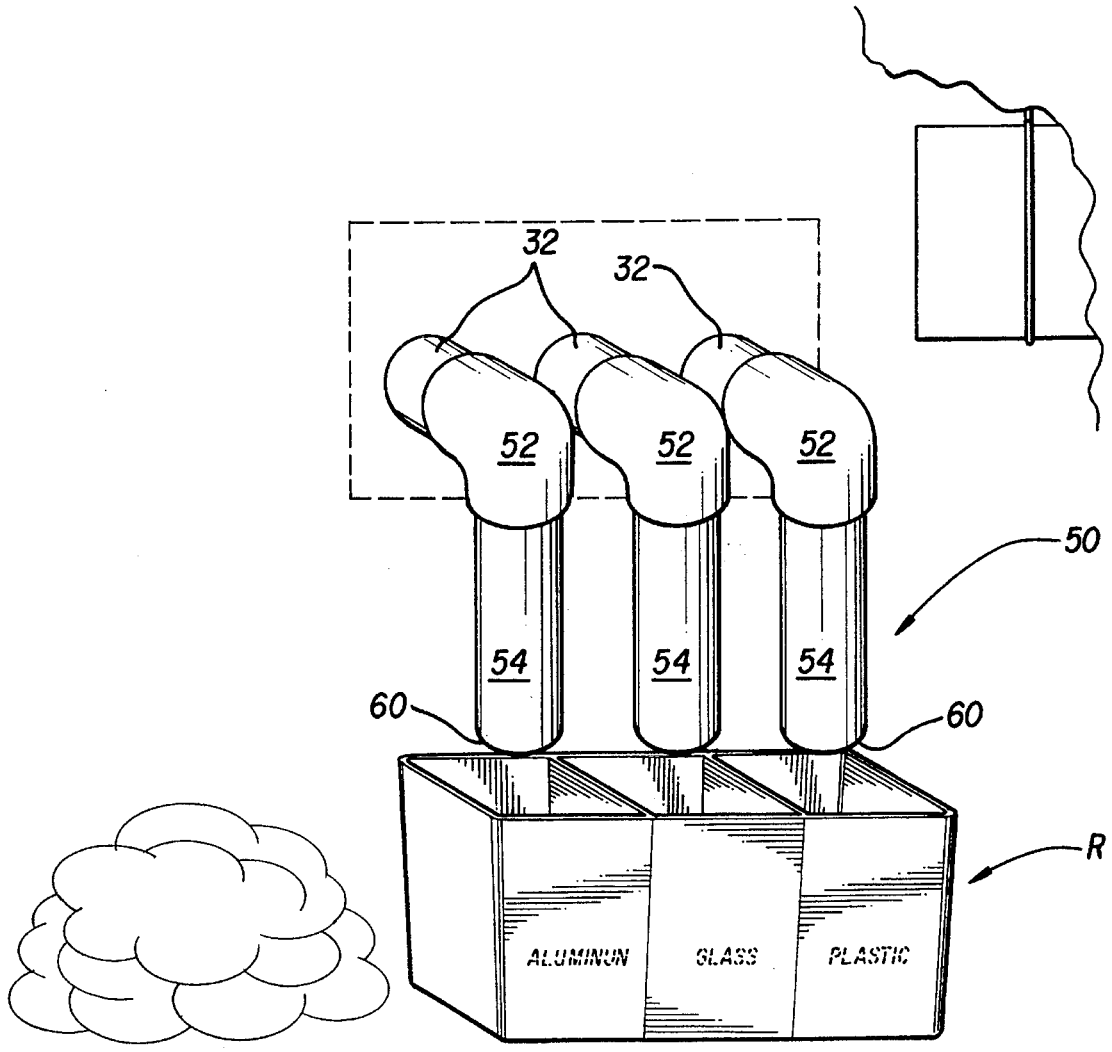
FIG. 3 is a perspective view of the outside of a house with the present invention in place.

First, attention will be drawn to the wall mounted 20 unit seen in FIGS. 1 and 2. In the preferred embodiment, this is a generally rectangular box 22 having one open side 24. The box 22 is appropriately dimensioned so that it can be placed in a conventional domicile wall W (seen in FIG. 1). The wall W has an interior side W1 and an exterior W2, the exterior being understood to be the exterior wall of the house or domicile. Preferably, the box 22 would be placed between a pair of the wall studs included in said wall W and could be retained to them. The box 22 has a lip 26, shown in broken lines in FIG. 2, extending from about the periphery of the open side 24. This lip 26 assists in mounting the box 22, by allowing threaded members 28 or the like to be used in further securing the box 22 to the wall W. The box 22 has a conduit mouth wall 30 opposite the open side 24. Disposed on the conduit mouth wall 30 are the conduit mouths 32, shown in FIG. 2.

In the preferred embodiment shown herein, the mouths 32 are three in number, though it should be understood that more or less could be utilized, depending on the local recycling requirements and regulations. These mouths 32 are preferably made from six inch diameter piping, with a PVC type polymer being an obvious choice for a material, although any number of materials would be obvious to the skilled artisan. The mouths 32, as seen in FIG. 1, extend partially into the interior of the box 22 and also extend out past the exterior wall W2. The mouths 32 would be attached to the conduit mouth wall 30 of the box 22 by adhesive or similar means after bores of sufficient size were made therein.

On the top edge 34 of the open side 24 of the box 22 is a hinge means 36 (seen in FIG. 1). This can extend partially or completely along the top edge 34 and has attached a cover 40. The cover moves as indicated by directional arrow A1 in FIG. 1 to an opened or a closed position. The hinge means 36 could be of a spring biased type to hold the cover 40 in either the open or closed position or it could be free swinging. The cover 40 is made of, or has contained therein, an insulating material, such as blown plastic or fiberglass, so that when the cover 40 closes the open side 24 of the box 22 a minimal amount of heat or cooling loss from the interior of the domicile passes through to the outside. To add to this insulating ability, biased hinged means (not shown) could be placed on the terminal ends 60 of the conduit portions 50 such that these covers would be held closed until a recyclable object was deposited into the device 10.

The discussion now turns to the conduit means or portions 50. In the embodiment described herein, these comprise a 90° bend or elbow portion 52 and a straight disposal portion 54. Both these portions 52, 54 could also be made of six inch diameter piping as were the conduit mouths 32 above. Any number of well known means such as threaded collars (not shown), adhesive, or the like could be used to fasten the portions together. As mentioned above, the disposal portions 54 each have terminal ends 60. These are disposed at a distance above the receptacles R such that the receptacles R can be removed easily for curbside pickup or transportation to a recycling center.

Though the conduit means shown in the figures and described in the above specification are six inch piping with a 90° bend or elbow therein, it should be emphasized that different configurations of the conduit could be utilized without departing from the spirit of the invention. The mouth portions 32 could be set at a downward angle, for instance, and the elbow portion thus be less than 90° to aid in impelling the recyclable materials into the receptacles R. Additionally, the diameter of the piping could be made larger to accommodate larger recyclable materials, such as the two liter soda containers that are recycled in some localities.

Following hereinafter is a list of the elements in the above specification:

| | |
|---|---|
| apparatus | 10 |
| wall mount unit | 20 |
| conduit portions | 50 |
| rectangular box | 22 |
| open side | 24 |
| domicile wall | W |
| interior side | W1 |
| exterior side | W2 |
| lip | 26 |
| threaded members | 28 |
| conduit mouth wall | 30 |
| conduit mouths | 32 |
| hinge means | 36 |
| cover | 40 |
| directional arrow | A1 |
| elbow portion | 52 |
| straight disposal portion | 54 |
| receptacles | R |

It is to be understood that the present invention is not limited to the sole embodiment described above, but encompasses any and all embodiments within the scope of the following claims.

We claim:

1. In combination with an exterior wall of a domicile, said wall having a first side facing the interior of the domicile and a second side facing the outdoors, an apparatus for segregating and storing segregated recyclable materials comprising:

a wall mounted unit disposed within and between studs in said exterior wall, said wall mounted unit having a means defining an opening proximate said first side of said wall and a conduit mouth wall having a plurality of apertures proximate said second side of said wall for receiving segregated recyclable materials, and insulated cover means hinged at the top of said opening to move between a position closing said opening and a raised position permitting deposit of the recyclable materials through said apertures with the space between said opening and said conduit mouth wall forming a generally rectangular open box providing direct simultaneous access to all of said apertures;

separate containers for each of the segregated recyclable materials located outside of said domicile and lined up on the ground below said wall mounted unit; and hollow conduit means comprising a tube of circular cross section for each of said apertures being attached to said conduit mouth wall of said wall mounted unit and forming fluid communication with the interior thereof through said apertures and bent down through an elbow just outside of said wall and further including a terminal end disposed downwardly from said conduit mouth wall and outward from said second side of said exterior wall such that said segregated recyclable materials may be deposited into said wall mounted unit through said opening means and said apertures and conveyed by gravity through said conduit means outdoors for storage in said containers.

* * * * *